United States Patent [19]

Jurek

[11] Patent Number: 4,823,570

[45] Date of Patent: Apr. 25, 1989

[54] LOCKING MECHANISM FOR VENDING MACHINES

[75] Inventor: Richard D. Jurek, Lakeville, Minn.

[73] Assignee: Air-Vend, Inc., Mendota Heights, Minn.

[21] Appl. No.: 68,422

[22] Filed: Jul. 1, 1987

[51] Int. Cl.[4] ..... E05C 19/18

[52] U.S. Cl. ..... 70/129; 49/395; 70/159; 70/417; 70/DIG. 64; 220/315; 292/153; 292/259 R; 292/302; 312/219

[58] Field of Search ..... 70/417, DIG. 64, DIG. 65, 70/DIG. 66, DIG. 41, DIG. 56, 101, 102, 104, 86, 129, 78, 159, 164; 292/259 R, DIG. 18, 302, 153; 220/315; 49/394, 395; 312/219

[56] References Cited

U.S. PATENT DOCUMENTS

| | | | |
|---|---|---|---|
| 168,566 | 10/1875 | Hilton | 70/DIG. 56 X |
| 1,281,279 | 10/1918 | Bodimer . | |
| 1,391,044 | 9/1921 | Buzzaird | 70/DIG. 41 |
| 1,597,723 | 8/1926 | Collins . | |
| 2,228,361 | 1/1941 | O'Neil | 70/101 |
| 2,373,783 | 4/1945 | Schlifer | 70/101 |
| 2,599,527 | 6/1952 | Badger | 292/259 R |
| 3,002,800 | 10/1961 | McMahan | 292/259 R X |
| 3,154,937 | 11/1964 | Reeves . | |
| 3,759,072 | 9/1973 | McLarnon | 70/104 X |
| 3,770,930 | 11/1973 | Tang | 70/104 X |
| 3,844,144 | 10/1974 | Schmitt | 70/417 X |
| 3,866,961 | 2/1975 | List | 292/336.3 |
| 4,237,709 | 12/1980 | Krugener et al. | 70/107 |
| 4,262,503 | 4/1981 | Keubler | 70/DIG. 64 X |
| 4,350,032 | 9/1982 | Kochackis | 70/56 X |
| 4,418,551 | 12/1983 | Kochackis | 70/18 |
| 4,452,371 | 6/1984 | Jurek | 70/56 X |
| 4,455,846 | 6/1984 | Wichinsky | 70/94 |
| 4,466,264 | 8/1984 | del Nero | 70/417 |
| 4,491,354 | 1/1985 | Williams | 292/259 R X |
| 4,500,123 | 2/1985 | Harms | 292/259 A |
| 4,549,418 | 10/1985 | Hall | 70/417 X |
| 4,562,708 | 1/1986 | Gros | 70/94 |
| 4,669,767 | 6/1987 | Leto | 70/DIG. 65 X |
| 4,741,454 | 5/1988 | Ray et al. | 70/78 X |

FOREIGN PATENT DOCUMENTS

| | | | |
|---|---|---|---|
| 352418 | 4/1922 | Fed. Rep. of Germany | 70/104 |
| 19168 | of 1909 | United Kingdom | 70/104 |
| 10602 | of 1913 | United Kingdom | 70/118 |
| 355199 | 2/1930 | United Kingdom | 292/259 R |
| 2068051 | 8/1981 | United Kingdom | 70/417 |

*Primary Examiner*—Lloyd A. Gall

*Attorney, Agent, or Firm*—Orrin M. Haugen; Thomas J. Nikolai; Frederick W. Niebuhr

[57] ABSTRACT

A locking mechanism to secure a coin operated vending machine includes an elongate locking bar insertable into a housing of the vending machine to secure closed a door hingedly mounted to the housing. A pair of metal loops integral with the door, and a pair of cover plates integral with the housing, are aligned to simultaneously contain the locking bar when the door is closed. A key-operated lock cylinder, mounted in recessed fashion inside the housing, supports a latch for pivotal movement toward and away from a latching position, wherein the latch enters a slot formed in the locking bar to keep the locking bar in its locking position. A reinforcing plate, with a keyway and a larger opening to permit insertion of the locking bar, protects the locking mechanism against tampering to discourage unauthorized entry into the vending machine.

12 Claims, 2 Drawing Sheets

LOCKING MECHANISM FOR VENDING MACHINES

BACKGROUND OF THE INVENTION

This invention relates to coin operated, automatic vending machines, and more particularly to locking devices for preventing unauthorized entry into such machines.

Coin operated vending machines are widely recognized as a convenient approach to marketing various products, for example soft drinks and other food items, along with video games, car washes and other services. Such machines can make products and services available on a twenty-four hour basis, without the need for an operator or other attendant. This reduces the vendor's marketing cost, and also makes such products and services available in areas considered too remote to justify the expense of other retail marketing approaches.

A serious disadvantage, particularly for vending machines left unattended for substantial amounts of time, is that the machines are subject to tampering and unauthorized entry and theft. This has given rise to the development of locking mechanisms designed to safeguard unattended vending machines. For example, U.S. Pat. No. 4,562,708 to Gros granted Jan. 7, 1986 discloses a locking device for coin operated video games. The device includes a bar having a curved tongue at one end and a slot at the other. The tongue fits through notches provided in a receiving member, while the slot fits over an eye-bolt and is held in place with a padlock.

Another locking device for a video game is shown in U.S. Pat. No. 4,455,846 to Wichinsky granted June 26, 1984. An adjustable locking pin assembly is said to receive a locking lever, which pivots as a key rotates a barrel lock, thus to secure a flat seal bar across the door to the machine. Further locking devices, although not specifically related to vending machines, are disclosed in U.S. Pat. No. 4,237,709 (Krugener) and in U.S. Pat. No. 3,866,961 (List).

A tamper resistant equipment housing is disclosed in U.S. Pat. No. 4,452,371 to Jurek granted June 5, 1984 and assigned to the assignee of this application. A door of the housing is secured closed by a vertical slide bar directed through an opening at the top of the housing, a similar opening in a recessed housing at the bottom of the enclosure, and a pair of metal loops in the door. A padlock keeps the slide bar in place. This device and the others just discussed are satisfactory for certain applications, but there remains a need for a locking mechanism that is convenient to use yet virtually secure from unauthorized entry.

Therefore, it is an object of the present invention to provide an automatic vending device in which the working parts of the locking mechanism are recessed inside the housing.

Another object of the invention is to position the locking mechanism working parts so that they are not readily observed from outside of the housing.

Yet another object is to provide a vending machine locking mechanism utilizing a conventional key-operated locking cylinder, with means to protect the locking cylinder against damage or attempts to pick the lock.

SUMMARY OF THE INVENTION

To achieve these and other objects, there is provided in an enclosure including a housing and an access means movable with respect to the housing for alternatively permitting and denying access to the interior of the enclosure, an apparatus for securing the enclosure against unauthorized entry. The apparatus includes a first containing means integral with the housing, and a second containing means integral with the access means and substantially aligned with the first containing means whenever the access means is closed. The apparatus further includes an elongate, substantially rigid locking member, and a first opening through a wall portion of the housing to permit insertion of the locking member in a longitudinal direction into the enclosure, to a locking position wherein the locking member is simultaneously contained by the first and second containing means to prevent the opening of the access means. A locking member retaining means is mounted with respect to the housing for movement inside the enclosure between a latching position wherein the retaining means engages the locking member to maintain the locking member in the locking position, and a release position disengaged from the locking member to permit movement of the locking member from the locking position.

Preferably, the retaining means includes a longitudinally directed lock cylinder, operable by a key to pivot a latch in a transverse plane. A latch receiving slot is formed in the locking member at a location for receiving the latch whenever the locking member is in its locking position. Also, the lock cylinder is advantageously mounted to a cover plate recessed inwardly from the wall portion. A substantially planar reinforcing plate can be fixed to the wall portion and provided with an opening corresponding to and adjacent to the first opening, and a keyway for admitting a key to operate the lock cylinder. The reinforcing plate prevents direct access to the lock cylinder to discourage attempts to pick the lock, and other tampering. Further, it substantially hides the lock cylinder from view, so that a potential intruder may not be aware of the lock cylinder.

In operating the vending device, the authorized user inserts the locking member into the vending housing with the door (or other access means) closed until the locking member reaches its locking position, then turns the key to rotate the latch into its retaining position. Later, the key may be reinserted to rotate the latch to its release position, releasing the locking member. Thus, the disclosed locking mechanism discourages theft and tampering, but is convenient for the user familiar with its operation and having the required key.

IN THE DRAWINGS

The above and other features and advantages will become apparent upon a reading of the following detailed description and consideration of the drawings, in which.

DETAILED DESCRIPTION OF THE PREFERRED EMBODIMENT

Figure 1:
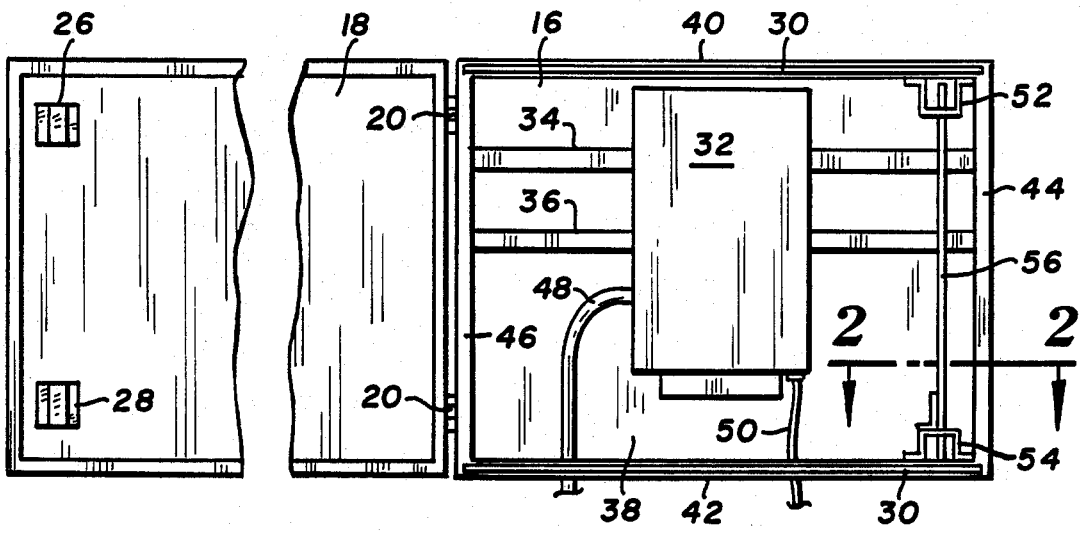
FIG. 1 is a front elevation of a coin operated vending device equipped with a locking mechanism in accordance with the present invention.

Turning now to the drawings, there is shown in FIG. 1 an automatic, coin operated vending device for supplying pressurized air to maintain the inflation of tires for passenger cars and other vehicles. For mounting structure and other details related to the vending device, reference is made to the aforementioned U.S. Pat. No. 4,452,371, incorporated herein by reference. The functional components of the vending device are housed in an enclosure or cabinet formed by a housing 16 and a door 18 pivotally mounted to the housing by hinges 20. A coin meter and a coin container (not shown) can be mounted to the inside surface of door 18, with customers supplying coins through a coin slot to operate the device. Also mounted to the door, along the edge opposite hinges 20, are upper and lower metal loops 26 and 28. Two elastic pads 30 are placed on the inside edge or jamb portion of housing 16.

An air compressor 32 and related components are mounted inside housing 16. A pair of horizontal support ribs 34 and 36 provide a means to mount the compressor and reinforce a back panel 38 of the housing. Mounted to the back panel and extended forwardly thereof are a top wall 40, a bottom wall or floor 42, and two opposed side walls 44 and 46. An air hose 48, in fluid communication with compressor 32, extends out of the cabinet through an opening in floor 42, as does an electrical line 50 for supplying power to the compressor.

An upper cover 52 and a lower cover 54, both box-like and formed of sheet metal, are provided near the right forward edge of housing 16 at its top and bottom, respectively. Each of the covers includes an opening configured to receive and contain an elongate locking bar 56 against any substantial horizontal movement, with respect to the housing, when the locking bar is positioned vertically and fully inserted into the housing as shown. When locking bar 56 is similarly positioned and with door 18 closed (not shown), the locking bar is contained by loops 26 and 28 as well as the upper and lower cover plates. Hence, the cover plates and loops cooperate to provide a locking bar containing structure which secures door 18 closed as long as the locking bar remains fully inserted into the housing.

Figure 2:
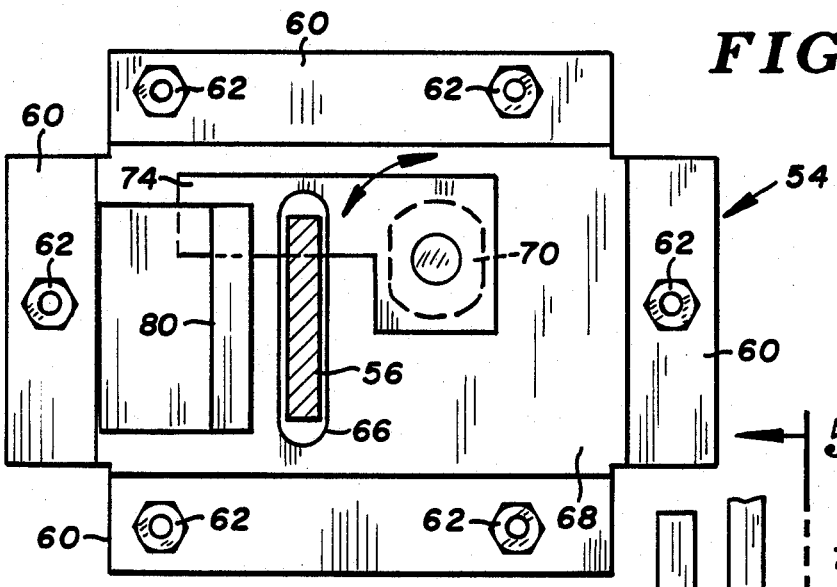
FIG. 2 is an enlarged sectional view taken along the line 2—2 in FIG. 1.
Figure 3:
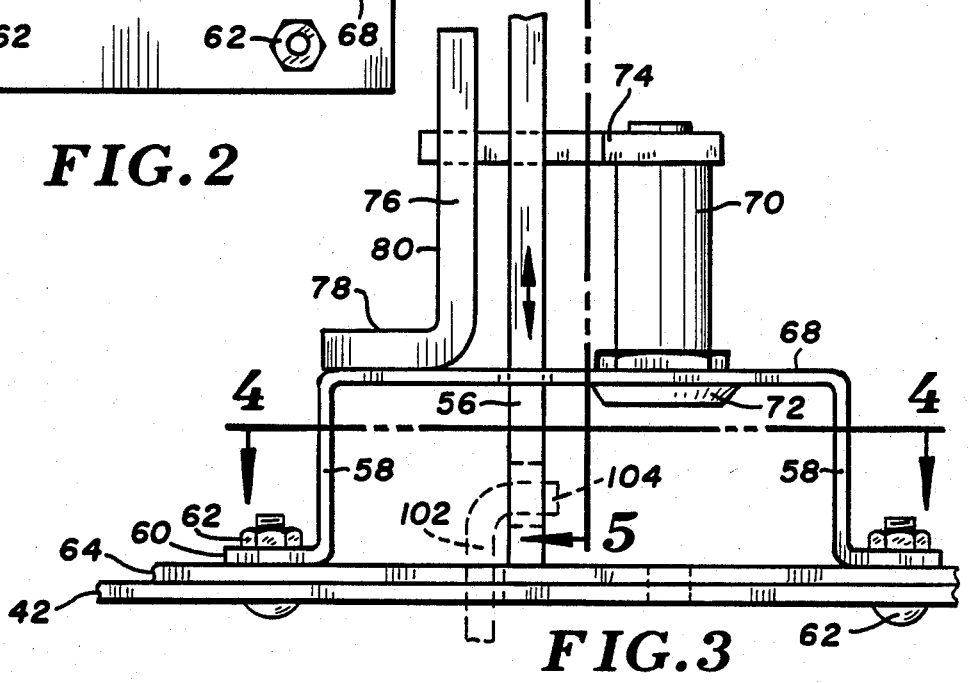
FIG. 3 is a elevational view of the locking mechanism.

FIGS. 2 and 3 show lower cover 54 and its immediately adjacent structure in greater detail. Lower cover 54 is a sheet metal member, with four extensions, bent 90° once to form four vertical side walls 58, then bent 90° once again to form horizontal and outwardly extended flanges 60. Cover 54 is secured to floor 42 by a plurality of nut and bolt assemblies 62, each extended through an opening in one of the flanges. A reinforcing plate 64, constructed of seven-gauge steel, is mounted between the lower cover and floor. Preferably the nut and bolt assemblies have carriage bolt type heads below floor 42 to discourage any tampering with these assemblies from outside of the cabinet.

An elongate opening 66, with a shape and size corresponding to the transverse cross-section of locking bar 56, is formed in a lower cover plate 68 of cover 54. Another opening is formed through the cover plate to accommodate a key-operated lock cylinder 70, directed vertically upward from cover plate 68. A key-receiving face 72 of the locking cylinder lies against the lower surface of the cover plate, while a latch 74 is attached to and extends transversely outwardly of the opposite end of the lock cylinder. As seen from FIG. 2, lock cylinder 70 is operable to pivot latch 74 counterclockwise to a latching position shown in solid lines, and clockwise to a release position.

A generally L-shaped retaining bar 76 is fastened to lower cover plate 68, for example by welding a base portion 78 of the bar to the cover plate. An upright portion 80 of the retaining bar is positioned near and parallel to locking bar 56 when the locking bar is inserted into the cabinet.

Figure 4:
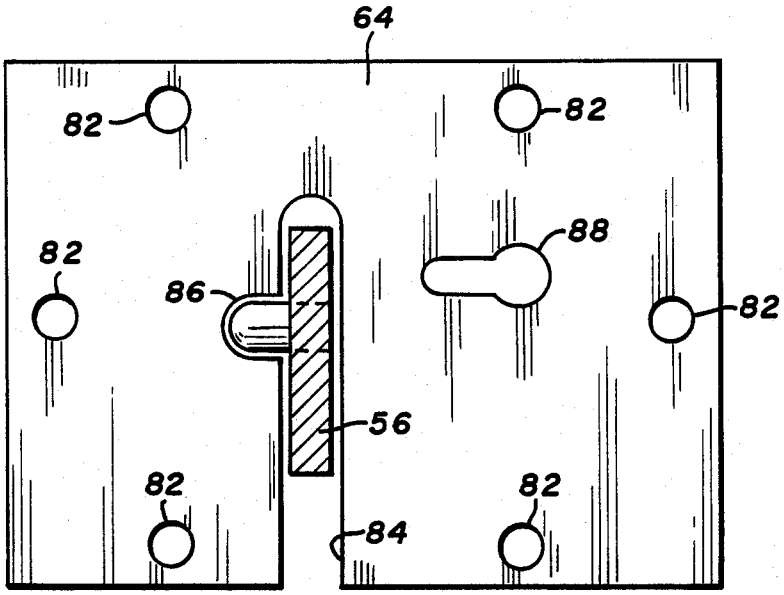
FIG. 4 is a sectional view taken along the line 4—4 in FIG. 3.

FIG. 4 shows reinforcing plate 64 in greater detail. A plurality of openings 82 are formed through the reinforcing plate to accommodate the nut and bolt assemblies. Also formed in plate 64 is an elongate opening 84 corresponding in size and shape, and in longitudinal alignment with, opening 66 in the lower cover plate. Also, however, opening 84 is enlarged with a notch 86 in order to permit insertion of a tool, as is later explained. Also provided through plate 64 is a keyway 88, to permit insertion of the key (not shown) used to operate lock cylinder 70 to pivot latch 74. Corresponding openings are formed through floor 42 to admit the locking bar and key, respectively.

Figure 5:
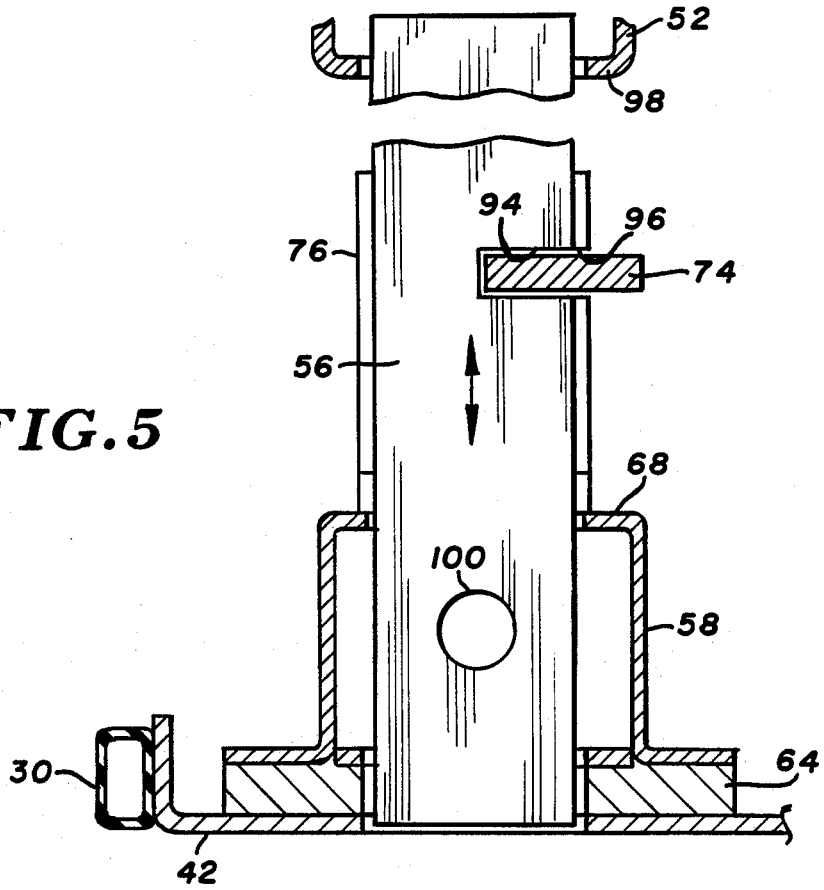
FIG. 5 is an enlarged sectional view taken along the line 5—5 in FIG. 3.

As seen in FIG. 5, locking bar 56 is provided with a slot 94 open to the rearward edge of the locking bar and extended approximately halfway across the locking bar width. A retainer slot 96, substantially identical in shape and size to slot 94, is similarly formed in the upright section of retaining bar 76. As retaining bar 76 is integral with lower cover plate 68, slot 96 is permanently positioned to receive latch 74 whenever the latch is pivoted to the retaining position. Slot 94, by contrast, is positioned to receive the latch only when locking bar 56 is fully or at least approximately fully inserted.

As is apparent in FIG. 5, when the locking bar is properly inserted, its upper end extends into upper cover 52. The amount of such extension is not critical, save for the requirement that a sufficient portion of the locking bar extend upwardly beyond an upper cover plate 98 of upper cover 52 to assure that the locking plate effectively contains the locking bar. An opening in the upper cover plate has substantially the same size and shape as opening 66 in the lower cover plate, and is in longitudinal alignment with openings 66 and 84.

An aperture 100 is formed in locking bar 56 near its lower end. A tool 102 (FIG. 3) has a hook portion 104 which is insertable through notch 86 in reinforcing plate 64, if necessary, to engage the locking bar through aperture 100.

While latch 74 is required to positively retain locking bar 56 in it locking position, loops 26 and 28 can be configured for a relatively close fit around the locking bar. Further, each pad 30 is configured to be at least slightly elastically compressed when door 18 is closed against housing 16. Consequently, the elastic force in the pads tends to push outwardly upon door 18 when it is closed, causing the loops and cover plate to cooperatively and frictionally hold locking bar 56 in place when it is fully inserted with the door closed.

One feature of the present invention resides in the fact that the interaction of latch 74 and locking bar 56, more particularly the entry of the latch into slot 94, occurs inside the closed container and out of view. Consequently it is virtually impossible for an intruder to determine the manner in which latch 94 and locking bar 56 cooperate, without first observing these components with door 18 open. Further, due to the correspondence in size between slot 94 and latch 74, the latch will not enter the slot unless locking bar 56 is properly inserted.

A further advantage of the present invention is the recessed mounting of lock cylinder 70. Due to the relatively small size of opening 84 through reinforcing plate 64, the presence and nature of the locking cylinder are hidden from the casual observer. Even when known to a potential intruder, the recessed lock cylinder is protected from bolt cutters, hacksaws, and similar tools, and "picking" of the lock cylinder is rendered more difficult by the small size of keyway 88 and its vertical separation from key-receiving face 72.

In ordinary usage, an operator periodically opens door 18 to empty the coin container and inspect compressor 32 and the other components housed in the cabinet. The operator opens door 18 by inserting the key and rotating it to pivot latch 74 clockwise as viewed in FIG. 2, disengaging it from the locking bar. Ordinarily, due to the elastic force of pad 30 acting upon the door and housing, loops 26 and 28, cover plates 68 and 98, and reinforcing plate 64 cooperate to frictionally maintain locking bar 56 in the locking position. In this event, the operator pushes door 18 inwardly against housing 16, whereupon the locking bar is released and falls out of the cabinet due to gravity.

However, should gravity be insufficient to remove locking bar 56, or in the case of a horizontal positioning of the locking bar, tool 102 can be inserted into the cabinet through notch 86, positioned so that hook end 104 extends through aperture 100 in the locking bar, then pulled outward to withdraw locking bar 56 from the cabinet.

After emptying the coin container 24 and performing any required servicing, the operator closes door 18, inserts locking bar 56 vertically upward through floor 42 until the bottom of the bar is at least as high as the floor, and uses the key to pivot latch 74 into its latching position. In this position latch 74 is contained in retainer slot 96 as well as the locking bar slot 94, and thus is positively restrained against longitudinal movement on both sides of the locking bar. This arrangement stabilizes the locking bar position, and substantially increases resistance to attempts to displace the locking bar, for example by pounding its bottom edge. Plate 64, by virtue of opening 84, cooperates with cover plate 68 to properly align locking bar 56 as it is inserted. Once the locking bar is fully inserted, the reinforcing plate assists in stabilizing the bar position and contains the lower end portion of the bar to provide added locking strength.

What is claimed is:

1. In an enclosure including a housing and an access means movable with respect to the housing for alternatively permitting and denying access to the interior of the enclosure, an apparatus for securing said enclosure against unauthorized entry, including:

a first containing means integral with said housing, and a second containing means integral with said access means and substantially aligned with said first containing means whenever said access means is closed;

an elongate, substantially rigid locking member, disposed in a longitudinal direction and substantially uniform in transverse cross-section;

said first containing means including means forming a first retaining opening through a wall portion of said housing corresponding in shape to and slightly larger than the transverse cross section of the locking member, a substantially planar cover plate disposed generally in a transverse plane and fixedly mounted proximate to and in longitudinally inward spaced relation to said wall portion and means forming an opening through said cover plate comprising a second retaining opening having a size and shape corresponding to that of said first retaining opening, said retaining openings permitting longitudinal insertion of the locking member into said enclosure to a locking position wherein the locking member is simultaneously contained by said first and second containing means to prevent the opening of said access means, and wherein said locking member when so contained is contained within each of said first and second retaining openings; and a retaining member inside of said enclosure and a mounting means for supporting said retaining member inwardly with respect to said cover plate, for movement between a latching position wherein the retaining member engages said locking member to maintain the locking member in said locking position, and a release position disengaged from said locking member to permit longitudinal movement of the locking member away from said locking position.

2. The enclosure of claim 1 further including:

a means forming a transverse locking slot in said locking member, and wherein said retaining member comprises a latch movable substantially in a transverse plane, said latch when moved to said latching position with said locking member in said locking position entering said transverse locking slot to prevent any substantial longitudinal movement of said locking member away from the locking position.

3. The enclosure of claim 2 wherein:

said mounting means comprises a longitudinally directed key-operated lock cylinder mounted to said cover plate and extending inwardly thereof, said lock cylinder supporting said latch at its inward end for pivoting transversely relative to the housing.

4. The enclosure of claim 3 further including:

a longitudinally directed retaining bar integral with said housing and proximate said locking member when in said locking position, and means forming a retaining slot in said retaining bar, said retaining slot located to contain said latch when the latch is in said latching position and further transversely aligned with said locking slot when said locking member is in the locking position.

5. The enclosure of claim 4 wherein:

said retaining bar and said lock cylinder are on opposite sides of said locking member.

6. The enclosure of claim 3 wherein:

said mounting means further includes means fastening said lock cylinder to said cover plate with a key receiving face of said cylinder opposite said wall portion with the majority of said cylinder extended inwardly of said cover plate, and means forming a keyway through said wall portion and longitudinally aligned with said key-receiving face.

7. The enclosure of claim 6 wherein:

said access means comprises a door hingedly mounted to said housing.

8. The enclosure of claim 7 further including:

a resilient means between said door and said housing, said resilient means being at least slightly elastically compressed when the door is closed to urge said door away from said housing when said door is closed, thereby cooperating with said containing means to maintain said locking member in said locking position.

9. The enclosure of claim 8 further including:

means forming an aperture through said locking member at a location between said wall portion and said cover plate when the locking member is in said locking position, and wherein said locking member first retaining opening includes an access portion permitting insertion of a tool through said wall portion and into said aperture with the locking member in said locking position.

10. The enclosure of claim 1 further including:

a substantially planar reinforcing plate forming part of said first containing means and fixed to said wall portion, wherein said locking member first retaining opening is formed through said reinforcing plate.

11. The enclosure of claim 10 wherein:

said first containing means comprises said reinforcing plate, said cover plate, and a containing member mounted inside said enclosure and integral with said housing, and means forming an opening in said containing member and comprising a third retaining opening longitudinally aligned with said first and second retaining openings.

12. The enclosure of claim 11 wherein:

said access means comprises a door hingedly mounted to said housing, and said second containing means comprises a pair of longitudinally aligned, spaced apart loops mounted to said door.

* * * * *